United States Patent [19]

Durand

[11] Patent Number: 4,601,646

[45] Date of Patent: Jul. 22, 1986

[54] CENTRIFUGAL POSITIVE DISPLACEMENT DEVICE

[76] Inventor: John E. Durand, 27441 Ganso, Mission Viejo, Calif. 92691

[21] Appl. No.: 536,612

[22] Filed: Sep. 26, 1983

[51] Int. Cl.[4] ..... F04C 5/00

[52] U.S. Cl. ..... 418/153; 418/156

[58] Field of Search ..... 418/45, 153, 154, 156, 418/186

[56] References Cited

U.S. PATENT DOCUMENTS

| | | | |
|---|---|---|---|
| 2,455,194 | 11/1948 | Rumsey | 418/154 |
| 2,882,830 | 4/1959 | McDuffie | 418/154 |
| 3,041,979 | 7/1962 | McLean et al. | 418/154 |
| 3,207,070 | 9/1965 | Klinger et al. | 418/156 |
| 3,303,791 | 2/1967 | Doble | 418/154 |
| 3,639,091 | 2/1972 | Lewicki | 418/156 |

FOREIGN PATENT DOCUMENTS

| | | | |
|---|---|---|---|
| 244389 | 5/1963 | Australia | 418/153 |
| 737292 | 7/1943 | Fed. Rep. of Germany | 418/156 |
| 342087 | 12/1959 | Switzerland | 418/154 |

*Primary Examiner*—John J. Vrablik

*Attorney, Agent, or Firm*—Robert L. Sassone

[57] ABSTRACT

A centrifugal positive displacement device is presented. It is believed that this is the first type device which has the advantages of both a centrifugal pump and a positive displacement pump without any substantial disadvantages. The device comprises a casing similar to that of previous centrifugal casings disposed around an impeller smaller than prior art centrifugal impellers and having cavities in the outer surface thereof. On each side of each cavity is coupled a flexible loop. In operation, as it passes the cam, the flexible loop is filled with incoming fluid which is then compressed out as the cam is approached near the discharge port.

4 Claims, 5 Drawing Figures

CENTRIFUGAL POSITIVE DISPLACEMENT DEVICE

BACKGROUND OF THE INVENTION

1. Field of the Invention

The present invention relates to both centrifugal and positive displacement pumps, motors, and similar devices.

2. Description of the Prior Art

The prior art includes a substantial number of centrifugal pumping devices. These are relatively inexpensive compared to their capacity, can run and high speeds, and have numerous other advantages associated with centrifugal pumps. The prior art also includes a substantial number of positive displacement pumping devices. These can be very efficient at slow speeds, and in smaller sizes, and when lower flow rates are required.

In so far as applicant knows, up to the present time, these have been considered to be two different types of pumps, and no one has designed the pump having the advantages of both and the relative disadvantages as between the two of neither. The present invention is such a composite. In addition, its fabricating and manufacturing costs are substantially less than either of a prior art types of pumps of similar capacity and it lasts longer by a substantial margin than prior art centrifugal pumps.

SUMMARY OF THE INVENTION

A self priming centrifugal positive displacement device or pump is presented. The pump has a casing having interior surfaces defining a suction port, a discharge port and a generally cylindrical impeller chamber coupled to the suction port and discharge port. The chamber surface further defines a cylindrical cam parallel to the chamber surface. The chamber surface has a generally circular cross section except that the cam portion of the impeller chamber has smaller radii than the rest of the chamber. The chamber is similar to the chambers for prior art centrifugal vane pumps except that it is believed that for best results, discharge port and suction port should be on the same side of the chamber, a generally planar side perpendicular to an axis around which the chamber is disposed. displacement pumping device comprises an axial drive shaft symmetrically disposed about an axis and coupled to generally axially symmetric impeller coupling means. The impeller is in turn coupled to flexible loops which may form the periphery of the impeller or may just be coupled to the periphery of the impeller. The impeller coupling means and flexible loops have a length incrementally less than the length of the generally cylindrical impeller chamber. The impeller member has in a first example an exterior surface defining a a plurality of cylindrical cavities along the length of the impeller member. Each flexible loop is coupled to the exterior circular surface of the generally cylindrical shaped impeller member along a line parallel with the axis and on one side of a cavity and coupled at a second point around the cylindrical surface of the impeller just a short distance from the other side of the cavity. Means are coupled to rotate the axial drive shaft and impeller coupled thereto in a direction from the suction port toward the discharge port between that portion of the impeller chamber wherein there is no cam and from the discharge port to the suction port between that portion of the impeller chamber where there is a cam.

The design of the invention causes fluid to be sucked in the suction port when the impeller is rotated. The flexible loops form peripheral fluid drive means which are rigid when rotated between the suction port and the discharge port and flex when rotated between the discharge port and the suction port. The peripheral fluid drive means or loops utilize fluid coming in the suction port and centripetal force to give them their substantial rigidity whereby the impeller acts as a positive displacement impeller between the suction port and the discharge port.

The peripheral fluid drive means flex between the discharge port and suction port because the cam causes fluid to flow out the discharge port thereby substantially reducing the amount of fluid within the flexible loop so that they flex. Photographs have indicated that and wear patterns have confirmed that the loops ride on a thin layer of fluid and do not touch the interior walls of the casing thereby permitting substantially longer impeller life than in prior art centrifugal pumps. The compliant peripheral fluid drive means adapt to varying conditions of pressure, turbulence, flow rate, revolutions per minute and resulting conditions from variations of the preceeding so that the impeller need not be fabricated to close tollerances, thereby substantially reducing impeller fabrication costs to less than $1.00 for relatively large impellers. A first example of the impeller is fabricated in one piece, including loops from a strong flexible plastic such as poly vinyl chloride. The loops are similar to ribbons and can flex, while the center of the impeller-loop combination is relatively fixed. The suction port and discharge port may open onto the same generally planar surface generally perpindicular to the axis. Changing the direction of rotation of the impeller causes the discharge port to become the suction port and the suction port to become the discharge port because of the flexibility of the loops. The loops should be ribbon-like and slightly thicker along the center line with a gradual reduction in thickness toward the edges to reduce friction and wear by ribbon like, it is meant that the loops have a uniform width and cross section, except for the attachment point where they may be thicker, and are wide in relation to their thickness and long in relation in their width. Gas pumps may use weights on the ends of the loops.

DRAWING DESCRIPTION

Reference should be made at this time to the following detailed description which should be read in conjunction with the following drawings, of which:

FIG. 1 illustrates a partially cut away side view of an example of the invention along a plane perpendicular to the axis;

FIG. 2 illustrates a partially cut away side view of the invention 90° from the view of FIG. 1 in showing a part of a loop on top and on the bottom, of a partially cut off view of the region near the axis. The central portion of FIG. 2, because it is partially cut off in the way it is does not show the axial drive shaft as having edges perpendicular to the two parallel planar edges of the pump and shows the loops disposed at different distances from the center because one is near the cam;

DETAILED DESCRIPTION

Figure 3:
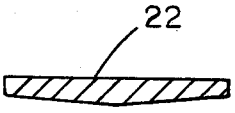
FIG. 3 illustrates a cross section of a loop showing the slightly thicker central portion and the taper utilized to reduce friction.
Figure 2:
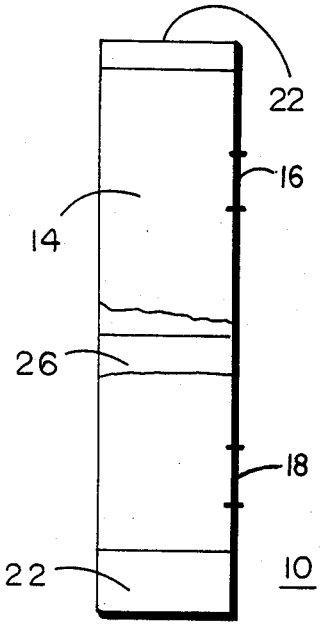
Figure 1:
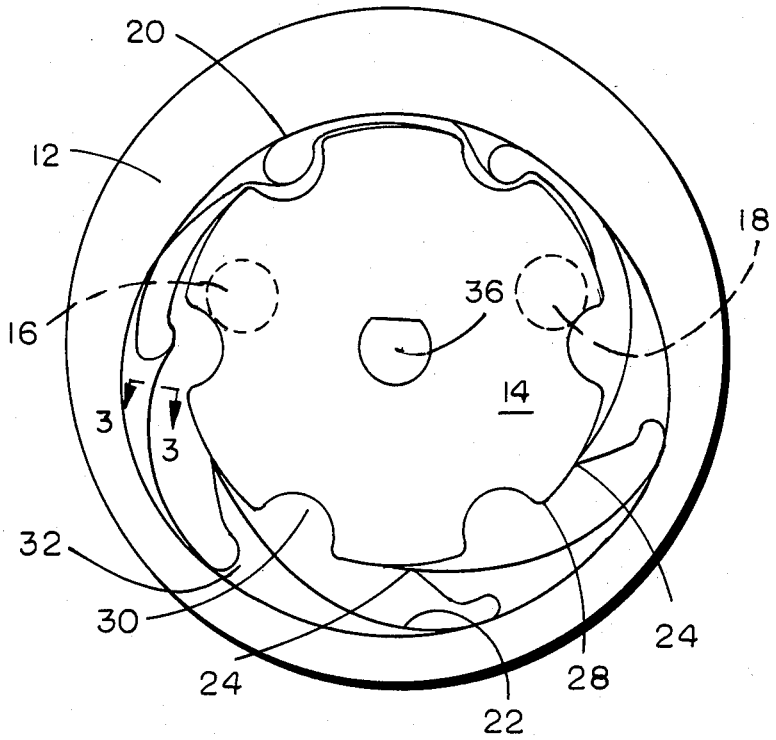

Reference should be made at this time to FIGS. 1-5 which illustrate various views of a centrifugal positive displacement device 10 or pump 10 according to the present invention. The pump 10 comprises a casing 12 of the type used for the prior art centrifugal pumps of slightly less capacity than the present pump 10. The casing should be the same size as a prior art pump of a lesser capacity because the present pump is more efficient than prior art centrifugal pumps. The casing 12 has interior surfaces defining a first suction port 18, a second or discharge port 16 and a generally cylindrical impeller chamber 32. The impeller chamber 32 includes a cam 20 which may be identical to prior art vane pump chamber cams. The suction port 18 and discharge port 16 may be identical to the prior art suction port and discharge port, of vane pumps or may be slightly greater because of the increased efficiency of the present design. The chamber 32 walls have a cam 20 in generally cylindrical shape. The impeller chamber 32 has a generally circular cross section and is partially axially symmetric except that the cam 20 portion of the impeller chamber 32 has smaller radii than the rest of the chamber 32. The dimensions of the cam 20 may be identical to those of a prior art vane pump cams. Cylindrical shape means that both the cam 20 and chamber 32 walls together form the walls of a curve extended in parallel lines to form a cylinder in a manner similar to a prior art vane pump chambers and cams.

A generally axially symmetric impeller 14 for the positive displacement pumping device 10 comprises an axial drive shaft 26 fixedly disposed around an axis 36 and coupled to generally axially symmetric impeller coupling means 14. The impeller 14 is in turn coupled to flexible loops 22. The impeller 14 and flexible loops 22 have a height parallel to the axis incrementally less than the length of the generally cylindrical impeller chamber 32. The increment may be the same as the increment by which prior art vane pump impellers are less long than the chambers in which they rotate. The impeller member 14 has an exterior surface defining a plurality of circumpherential cylindrical cavities 30 parallel to the axis and along the entire height of the impeller member 14 which is also referred to as impeller 14. Each flexible loop 22 is coupled to the exterior circumpherential surface of the generally cylindrical shaped impeller 14 along a line parallel with the axis 36 around which the axial drive shaft 26 is symmetrically oriented. Each flexible loop 22 first end 24 is coupled to the exterior circumpherential surface of the impeller 14 along a line parallel with the axis 36 and on one of the two sides of a cavity 30. The second end 24 is coupled to the exterior circumpherential surface of the impeller 14 along the line parallel with the axis and on the opposite side of the same cavity 30 from the connecting line of the first end 24. The ends 24 of the loops 22 are coupled about midway from the edges of the adjoining cavities 30 between which the end 24 is coupled.

A motor or other power means (not shown) which may be identical and coupled identically to those used with prior art centrifugal vane pumps is coupled to rotate the axial drive shaft 26 and impeller 14 coupled thereto in a direction from the suction port 18 toward the discharge port 16 adjacent and along that portion of the impeller chamber wall 32 wherein there is a cam 20.

In operation, fluid comes in the suction port 18 and centrifugal force causes the fluid to fill the loops 22. The loops 22 then become relatively rigid and the space between the loops 22 is also filled with fluid. The loops 22 ride on a fluid surface which is very thin and prevents the loops 22 from touching the interior surface of the impeller chamber 32.

When the loops 22 rotate as far as the discharge port 16, the cam causes the fluid adjacent the loops 22 to compress the loops 22 forcing the fluid out of the discharge port 16. Once again there is a very thin layer of fluid between the loops 22 and the cam 20 so that there is very little friction, vibration, or wear. Because the loops 22 are full of fluid when rotating between the suction port 18 and discharge port 16, the pump 10 has essentially all those advantages which make positive displacement pumps better than centrifugal pumps for certain applications and those which make centrifugal pumps better than positive displacement pumps, whether vane or two impeller, for the other applications.

Because the impeller 14 may only be generally circular, and the loops are relatively inexpensive, pumps of this type can be fabricated with less tolerance and at a cost substantially less than prior art centrigual pumps. The casing 12 can be substantially identical to prior art casings and the impeller cost is only a fraction of the cost of prior art vane impellers. Because the loops ride on a fluid film surface, there is practically no wear, and impellers according to the present design outwear the best prior art comparable vane impellers by a substantial factor. Impellers for relatively large centrifugal pumps according to the present design can be fabricated for $1.00 or less in quantity, a fraction of the cost of prior art impellers. Because of its unique design, a pump according to the present design is less expense than prior art pumps of similar capacity. The design of invention 10 causes fluid to be sucked in the suction port 18 when the impeller 14 is rotated. The flexible loops 22 form peripheral fluid drive means 22 which are rigid when rotated between the suction port 18 and the discharge port 16 and flex when rotated between the discharge port 16 and the suction port 18. The peripheral fluid drive means 22 or loops 22 utilize fluid coming in the suction port 18 and centripetal force to give them their substantial rigidity whereby the impeller 14 acts as a positive displacement impeller 14 between the suction port 18 and the discharge port 16.

The peripheral fluid drive means 22 flex between the discharge port 16 and suction port 18 because the cam 20 causes fluid to flow out the discharge port 16 thereby substantially reducing the amount of fluid within the flexible loops 22 so that they flex. Photographs have indicated that and wear patterns have confirmed that the loops 22 ride on a thin layer of fluid and do not touch the interior walls of the casing 12 thereby permitting substantially longer impeller 14 life than in prior art centrifugal pumps. The compliant peripheral fluid drive means 22 adapt to varying conditions of pressure, turbulence, flow rate, revolutions per minute and resulting conditions from variations of the preceeding so that the impeller 14 need not be fabricated to close tolerances, thereby substantially reducing impeller 14 fabrication costs to less than $1.00 for relatively large impellers 14.

A first example of the impeller 14 is fabricated in one piece, including loops 22 from a strong flexible plastic such as polyvinyl chloride. The loops 22 are similar to ribbons and can flex, while the center of the impeller-loop combination is relatively fixed.

An example of the invention is described herein. Other examples, of course, will be obvious to those skilled in the art. The invention is limited only the claims which follow the detailed description.

Because the loops 22 are flexible, they form compliant peripheral fluid drive means 22 which adapt to varying conditions of pressure, turbulence, flow rate, revolutions per minute of impeller rotation, and varying conditions which vary as a function of variations in the conditions set forth previously in this claim.

Figure 4:
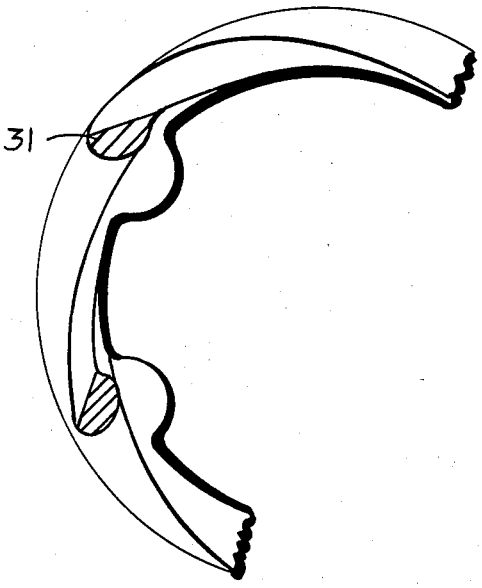
FIG. 4 illustrates a partially cut away side view of an example of the invention utilizing weights on the loops to increase centripetal force.
Figure 5:
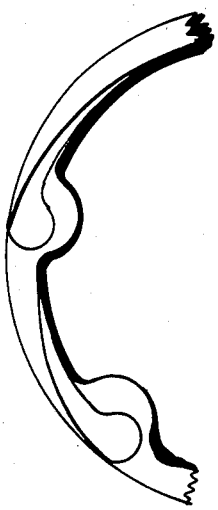
FIG. 5 illustrates an example of the invention more useful where the fluid is a liquid and having no weights on the ends of the loops.

The suction port 18 and discharge port 16 in this example open onto the same generally planar surface perpendicular to the axis. The loops 22 are sufficiently flexible so that changing the direction of rotation of the impeller 14 causes the discharge port 16 to become the suction port and the suction port 18 to become the discharge port. The loops 22 are ribbon-like, slightly thicker toward their center (equidistant from their two edges) and are wide compared to their thickness and substantially longer than their width. If a gas is to be pumped it may be helpful to utilize an example of the invention wherein the loops 22, as shown in FIG. 4 have a weight 31 coupled to them about equidistant from the ends 24 of the loops 22 forming the impeller-loop coupling means 24. In another example, the impeller 14, impeller coupling means 24 and loops 22 are fabricated in one piece from a strong, flexible plastic.

I claim:

1. A self priming centrifugal positive displacement device comprising: a casing having interior surfaces defining a suction port, a discharge port and a generally cylindrical impeller chamber which chamber is mostly axially symmetric and disposed about an axis having a radial surface axially symmetric between the suction port and discharge port in a selected direction of rotation, the radial surface defining a cylindrical cam of smaller radii than the rest of the chamber between the discharge port and the suction port;

a generally axially symmetric impeller having loop like peripheral fluid drive means which are rigid when rotated between the suction port and the discharge port and flex when rotated between the discharge port and the suction port and utilize fluid coming in the suction port and entering each loop like peripheral fluid drive means and centripetal force to give them their substantial rigidity whereby the impeller acts as a positive displacement impeller between the suction port and the discharge port and utilize the cam and lack of fluid between the discharge port and the suction port to cause the peripheral fluid drive means to flex between the discharge port and suction port;

the peripheral fluid drive means being sufficiently long so as to trail each coupling point where each peripheral fluid drive means is coupled to the generally axially symmetric impeller in form and length as determined by the resultant force lines of centripetal force and fluid resistance forces;

power means; and power transmission means coupled from the power means to selectively rotate the impeller.

2. The invention of claim 1 wherein the periphal fluid drive means are compliant and long enough to allow changes in points of contact with the casing interior surface and adapt to varying conditions of pressure, turbulence, flow rate, revolutions per minute of impeller rotation, and varying conditions which vary as a function of variations in the conditions set forth previously in this claim.

3. A self priming centrifugal positive displacement device comprising: a casing having interior surfaces defining a suction port, a discharge port, a generally cylindrical impeller chamber coupled to the suction port and discharge port wherein the chamber surface further defines a cylindrical cam parallel to the chamber having a generally circular cross section except that the cam portion of the impeller chamber has smaller radii than the rest of the chamber;

a generally axially symmetric impeller for a positive displacement pumping device comprising an axial drive shaft symmetrically disposed about an axis and coupled to generally axially symmetric impeller coupling means, in turn coupled to flexible loops, the impeller coupling means and flexible loops having a width incrementally less than the width of the generally cylindrical impeller chamber, the impeller having an exterior surface defining a plurality of cylindrical cavities along the length of the impeller member, each flexible loop being coupled to the exterior circular surface of the generally cylindrical shaped impeller along a line parallel with the axis and on one side of a cavity and coupled at a second point around the cylindrical surface of the impeller just a short distance from the other side of the cavity, the loops being sufficiently long so as to trail the loop coupling points in form and length as determined by the resultant force lines of centripetal force and fluid resistance forces and means coupled to rotate the axial drive shaft and impeller coupled thereto in a direction from the suction port toward the discharge port between that portion of the impeller chamber wherein there is no cam and from the discharge port to the suction port between that portion of the impeller chamber where there is a cam.

4. The invention of claim 3 wherein the suction port and discharge port open onto the same generally planar surface perpendicular to the axis, and the loops are sufficiently flexible so that changing the direction of rotation of the impeller causes the discharge port to become the suction port and the suction port to become the discharge port, and the loops are ribbon-like, slightly thicker toward their center, have a weight coupled to them, impeller coupling means, and loops may be fabricated in one piece from a strong, flexible plastic.

* * * * *